US006543961B1

(12) United States Patent
Rensel

(10) Patent No.: US 6,543,961 B1
(45) Date of Patent: Apr. 8, 2003

(54) DEVICE FOR SEALING JOINTS BETWEEN CONCRETE ELEMENTS

(76) Inventor: Torbjorn Rensel, Gaupefaret 4, N-3320 Vestfossen (NO)

( * ) Notice: Subject to any disclaimer, the term of this patent is extended or adjusted under 35 U.S.C. 154(b) by 0 days.

(21) Appl. No.: 09/631,853

(22) Filed: Aug. 3, 2000

(51) Int. Cl.[7] ..... E01C 23/02; B60P 1/04

(52) U.S. Cl. ..... 404/87; 404/107; 404/108; 404/110; 298/27; 222/181.2

(58) Field of Search ..... 404/84.1, 87, 105, 404/107, 108, 110; 222/181.2, 575, 612; 298/27

(56) References Cited

U.S. PATENT DOCUMENTS

| | | | | | |
|---|---|---|---|---|---|
| 1,029,894 | A | * | 6/1912 | Schellenger | 404/108 |
| 1,281,141 | A | * | 10/1918 | Coultas | 404/110 |
| 1,641,703 | A | * | 9/1927 | Stanton | 404/110 |
| 1,945,065 | A | * | 1/1934 | Mosslang et al. | 401/22 |
| 3,856,425 | A | * | 12/1974 | Miller et al. | 404/84 |
| 3,999,920 | A | * | 12/1976 | Cerillo, Jr. | 425/447 |
| 4,391,549 | A | * | 7/1983 | Murray | 404/87 |
| 5,234,128 | A | * | 8/1993 | Hill | 222/63 |
| 5,429,676 | A | * | 7/1995 | Uchida et al. | 118/310 |
| 5,458,169 | A | | 10/1995 | Biafore | 141/333 |
| 6,050,744 | A | * | 4/2000 | Binning | 404/108 |

FOREIGN PATENT DOCUMENTS

| | | | |
|---|---|---|---|
| DE | 2422159 | C2 | 11/1982 |
| DE | 4032577 | A1 | 4/1992 |
| GB | 2195137 | A | 3/1988 |
| NO | 13042 | | 11/1903 |
| NO | 65336 | | 10/1942 |

* cited by examiner

*Primary Examiner*—Gary S. Hartmann
(74) *Attorney, Agent, or Firm*—Sierra Patent Group, Ltd.

(57) ABSTRACT

A device for continuous supply of grouting into joints between longitudinal concrete elements, which are disposed chiefly horizontally next to each other to form, e.g., floors in building constructions. The device comprises a rhombic hopper adapted for displacement along the joint, wherein at least two side walls form an accumulating plow for leading the grouting in towards a vertical plane through the joint. The side walls of the hopper are latitudinally displaceable with respect to each other, and are held with an adjustable force against the surface of the concrete elements. The hopper is arranged below a discharge end of a container, the discharge end having a damper, which is operated by an actuator coupled to a level sensor in the hopper.

7 Claims, 2 Drawing Sheets

DEVICE FOR SEALING JOINTS BETWEEN CONCRETE ELEMENTS

BACKGROUND OF THE INVENTION

1. Field of the Invention

The present invention relates to a device for jointing of concrete elements.

2. Prior Art

During insertion of grouting (concrete) in the joint between disposed concrete elements, it is of significance that the grouting is supplied in a sufficient, not to large amount, and such that no mass is left on the concrete element surface, outside of the joint area itself. A problem in connection with known devices for jointing concrete elements, is that the elements because of variations during the molding of these may have different surface levels on the respective sides of the joint. Further the joint itself may between the concrete elements have a slightly different width, varying from producer to producer.

In today's introduction of grouting between the such disposed concrete elements, the grouting is supplied largely "batchwise", e.g. by a wheelbarrow, which is emptied along the joint, and thereafter the grouting is leveled manually, e.g. by the aid of spades. It has also been tried to supply the grouting by wheel carried box structures, which are driven along the joint. However, problems has then occurred wherein a significant part of the mass has ended up on the surface of the concrete elements, outside of the joint area itself. These present supply methods are labor intensive, both with respect to "delivery" and with respect to finishing treatment/cleaning, e.g., of the element surfaces outside of the joint area.

From the Norwegian patent 13042 it is known a groove filler for repair of highway lanes, consisting of a plurality of surfaces mounted with respect to each other, mainly in rhombic configuration, such that they during displacement along the highway, scrapes off tops and "hills" and carry the scraped off mass into and down to the worn sections, i.e. the "valleys" between the "hills".

From the German patent 2.422.159 a box like device is known for supply of grouting or concrete mass on bricks or similar blocks in a wall construction, before placement of a further layer of bricks or blocks, whereby at least one of the walls of the box is adapted for displacement in the height direction, for adjustment of the thickness of the deposited grouting.

BRIEF DESCRIPTION OF THE INVENTION

The present invention relates to a device for supplying grouting into the joint between disposed concrete elements, whereby the above mentioned disadvantages of the present supplying methods are overcome. The invention thus relates to such a device for continuous supply of grouting into joints between longitudinal concrete elements, which are disposed chiefly horizontally next to each other to form, e.g., floors in building constructions, comprising a rhombic hopper means adapted for displacement along the joint, wherein at least two side walls, which are adjoining each other in the hopper means, and which in operative condition of the hopper means are situated on opposite sides of a plane through the joint, together forms an accumulating plow for leading the grouting in towards a vertical plane through the joint, wherein the side walls are supported by a frame, are latitudinally displaceable with respect to each other, and under the effect of their own weight and possibly by the aid of a further, external direct action, are held with an adjustable force against the surface of the concrete elements, when the device is operated, wherein the hopper means is placed under the lower discharge end of a container, said discharge end being equipped with a damper means, which is operated by an actuator coupled to a level sensor in the hopper means.

The invention will be explained in more detail referring to the enclosed drawings, wherein the further details of the invention will be clarified, in which:

DETAILED DESCRIPTION OF THE PREFERRED EMBODIMENT

Figure 1:
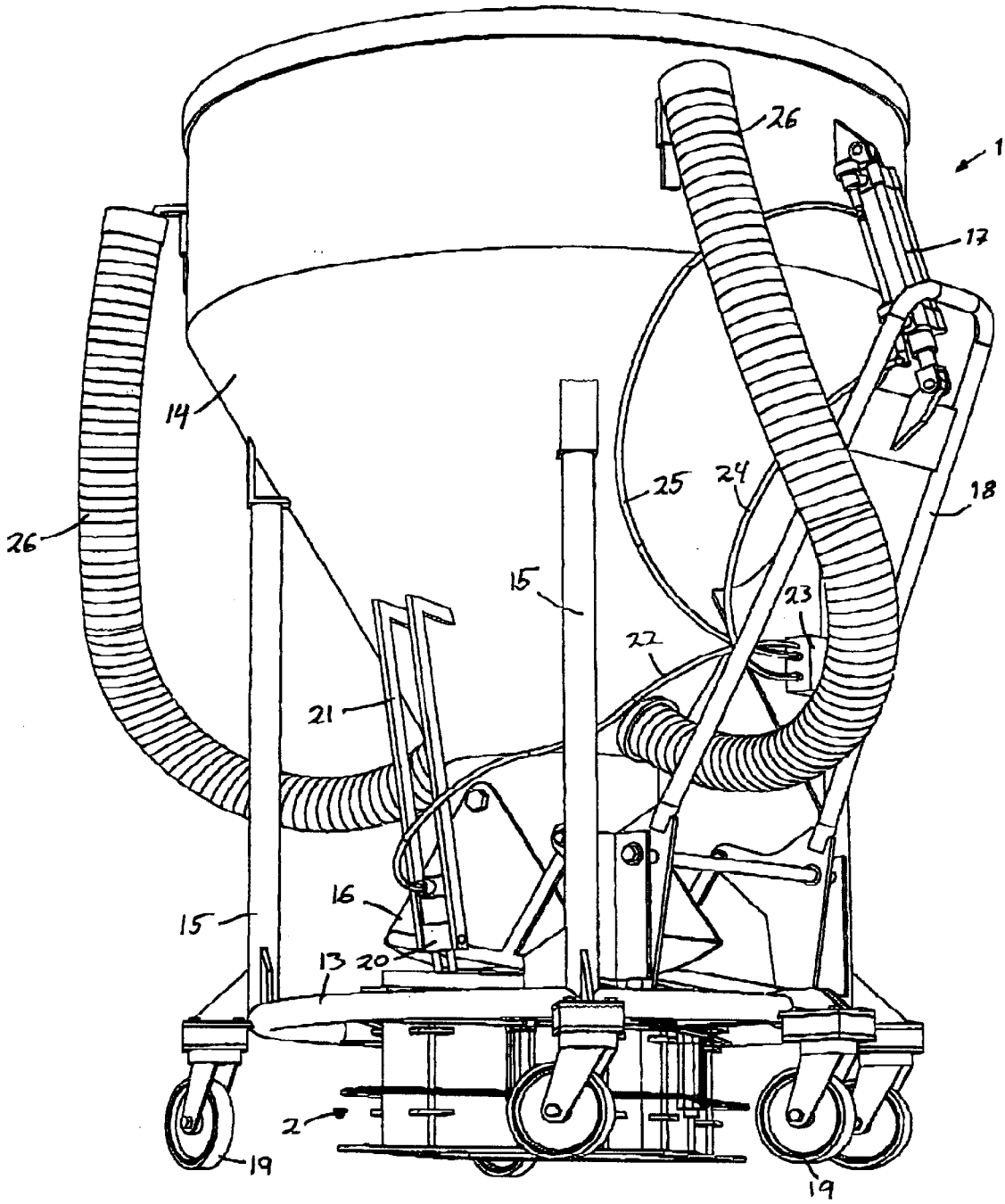
FIG. 1 shows the device according to the invention in perspective view.
Figure 2:
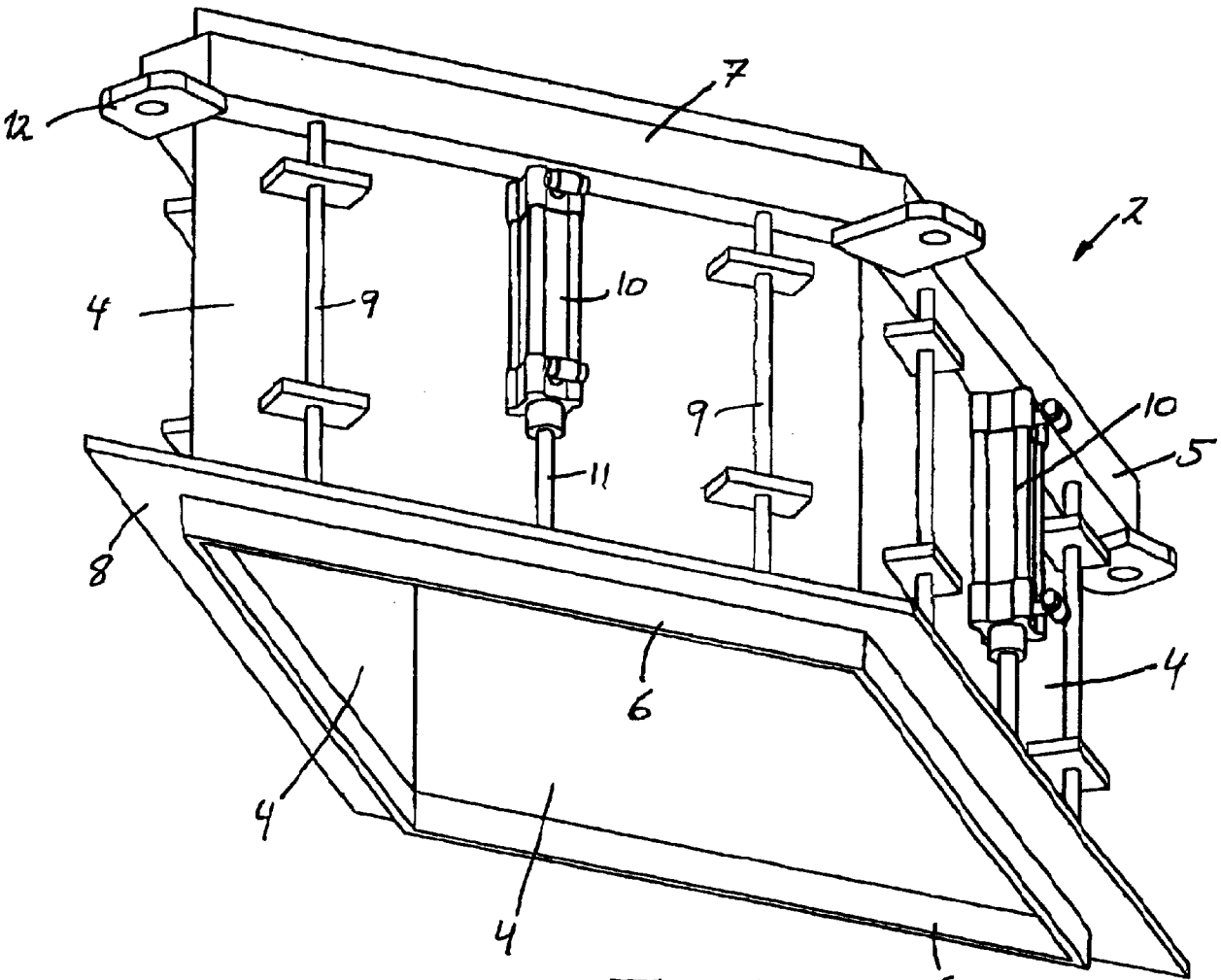
FIG. 2 shows the hopper means according to the invention in perspective view.

A device according to the invention, to be used for jointing, i.e. supply of grouting to a joint between concrete elements disposed side by side and optionally end to end, comprises a rhombic hopper 2 (FIG. 2), which four side walls 4 are latitudinally displaceably adjustable with respect to each other and are supported in a frame 5 in such a way that they are held with a set pressure against the surface of the concrete elements when concrete or other grouting is fed through the upper opening in the hopper, while the hopper and the associated frame are displaced along the joint between the concrete elements. Two of the side walls 4, which in the operative condition of the device are situated on opposite sides of a plane through the joint, form a "collecting plow" for guiding the grouting in towards the vertical plane through the joint, so that excess grouting material will not end up lying on the surface of the concrete elements outside of the joint area. Each of the side walls 4, which are formed of a stiff, strong material, e.g., steel plates, is designed with a lower wall part 6 of a strong, somewhat yielding material, e.g. rubber, which extends below the lowermost delimitation of the steel plate wall 4, and may thereby act as a doctor blade or scraper against the surface of the concrete elements, when the hopper is displaced along the joint, by the aid of means not shown, during supply of grouting. Excess grouting will thus be better scraped off of the surface of the concrete elements and in towards the joint.

Each and every side wall (with its associated lower side wall part 6 or lower lip) is adapted to be latitudinally displaceable with respect to each other to adapt the device to jointing of concrete elements with relative height difference of surfaces.

The frame 5 is divided into an upper frame part 7 and a lower frame part 8. The frame parts 7 and 8 are connected to each other by rods 9. An air actuator 10 is mounted on each of the side walls 4. The piston rod 11 of the actuator 10 is fixed to the lower frame part 8. When operating the actuator 10 each of the side walls may be displaced downward with a set force.

Via ears 12 the hopper means 2 is connected to a ring 13, which in turn is connected to a container 14 via bars 15. To the ring are also mounted a plurality of turnable wheels 19. The container is 14 upwardly open and is downwardly closed by a damper 16. The damper 16 is operated by an air cylinder 17, via an arm 18. When the damper 16 is open concrete may flow from the container 14 and down into the hopper means 2.

A level sensor 20 is attached to the container 14 via a pair of rods 21, so that the level sensor 20 extends down into the hopper means 2. The level indicator 20 is, via a line 22, connected to a control means 23. the control means is also connected to the air cylinder 17, via lines 24 and 25. When the level indicator gives a signal that the concrete level in the hopper means 2 is below a predetermined lower level, the control means opens a valve (not shown), which lets air into the air cylinder 17, so that this opens the damper 16. When the concrete level in the hopper 2 again has reached a predetermined upper level, the damper 16 is again closed.

By the aid of the wheels 19 the whole device 1 may be pulled or pushed along the joint, which is to be jointed. The lower wall parts 6 are pressed towards the concrete elements with a predetermined force, to form a seal and a doctor blade for the concrete in the joint. As the concrete flows down into the joint, the hopper means 2 is emptied. The hopper means is filled as the damper 16 is opened when the concrete level has sunk below a certain level.

To the container 14 is also connected two hoses 26. These are in non-operative position hooked to the upper end of the container 14. The hoses 26 may be unhooked and used to lead concrete out of the container to places which are inaccessible to the device 1, e.g., around pillars and along walls.

As the pressure from the concrete in the hopper means exercises a fairly large pressure against the joint, the concrete will be force well into the joint. However, after the filling of the joint, and when the jointing device has passed, the pressure be relieved and the concrete will again "rise". A ridge of 1–2 centimeters will occur in the joint, compared with the surrounding floor. To counteract this, it is, according to an aspect of the invention, also suggested the possibility of arranging a substantially horizontally pressure plate (not shown) behind the hopper means. The pressure plate presses vertically down towards the joint and counteracts thereby an overfilling of this. At the leading edge the pressure plate may be curved upwardly to facilitate a smoother sliding over the joint.

What is claimed is:

1. A device for continuous supply of grouting into joints between longitudinal concrete elements, which are disposed chiefly horizontally next to each other, comprising:

a rhombic hopper adapted for displacement along a joint, wherein at least two side walls, which are adjoining each other in said hopper, and which in operative condition of said hopper are situated on opposite sides of a plane through the joint, together forms an accumulating plow for leading the grouting in towards a vertical plane through the joint; and said hopper having side walls, which supported by a frame, are vertically displaceable with respect to each other said side wall, and under the effect of their own weight, are held with an adjustable force against the surface of the concrete elements, when the device is operated.

2. The device according to claim 1, wherein said side walls are held biased against the surface of the concrete elements by spring devices.

3. The device according to claim 1, wherein said side walls are held biased against the surface of the concrete elements by pneumatic means.

4. A device for continuous supply of grouting into joints between longitudinal concrete elements, which are disposed chiefly horizontally next to each other, comprising:

a rhombic hopper adapted for displacement along the joint, wherein at least two side walls, which are adjoining each other in said hopper, and which in operative condition of said hopper are situated on opposite sides of a plane through the joint, together forms an accumulating plow for leading the grouting in towards a vertical plane through the joint;

said side walls are supported by a frame, are vertically displaceable with respect to each other, and under the effect of their own weight are held with an adjustable force against the surface of the concrete elements, when the device is operated;

said hopper is arranged below a discharge end of a container; and said container having a damper means, which is operated by an actuator coupled to a level sensor in the hopper.

5. The device according to claim 4, wherein said device is equipped with wheels.

6. The device according to claim 4, wherein said side walls are biased against the surface of the concrete elements by pneumatic actuators.

7. The device according to claim 4, wherein said container is equipped with at least one hose, which is adapted to lead concrete from the container to a place which is inaccessible to the hopper.

* * * * *